United States Patent [19]

Wallis

[11] Patent Number: 4,934,230

[45] Date of Patent: Jun. 19, 1990

[54] DIE STAMPING SYSTEM

[76] Inventor: Bernard J. Wallis, 2215 Dacosta, Dearborn, Mich. 48128

[21] Appl. No.: 235,957

[22] Filed: Aug. 24, 1988

[51] Int. Cl.[5] ..... B21D 45/02; B26D 7/18

[52] U.S. Cl. ..... 83/128; 83/123; 83/137; 72/344; 72/427; 72/453.13; 267/119

[58] Field of Search ..... 83/128, 123, 137; 72/344, 427, 453.13; 267/119

[56] References Cited

U.S. PATENT DOCUMENTS

| | | | |
|---|---|---|---|
| 3,440,909 | 4/1969 | Schmid et al. | 83/123 X |
| 3,570,343 | 3/1971 | Wolnosky et al. | 83/124 |
| 3,739,669 | 6/1973 | Seki | 83/123 |
| 4,583,722 | 4/1986 | Wallis | 267/119 |
| 4,586,360 | 5/1986 | Jürgensmeyer et al. | 72/344 X |
| 4,774,865 | 10/1988 | Wallis | 83/128 |

*Primary Examiner*—Donald R. Schran

*Attorney, Agent, or Firm*—Barnes, Kisselle, Raisch, Choate, Whittemore & Hulbert

[57] ABSTRACT

A die stamping system includes opposed die members which clamp a metal workpiece to be shaped, cut or pierced after which the die members are moved away from one another and a part is subsequently ejected wherein the ejector is controlled for a selected delay time by a plurality of cylinder assemblies mounted in a manifold so that they are connected to a source of inert gas such as nitrogen under high pressure and to a source of hydraulic pressure. Each cylinder assembly includes a piston associated with and exposed to the nitrogen in the manifold. The cylinder assemblies are connected to a single hydraulic valve which has associated therewith an accumulator and which is operated simultaneously to actuate the cylinders. The hydraulic lines to the cylinders are provided in the manifold.

7 Claims, 6 Drawing Sheets

DIE STAMPING SYSTEM

This invention relates to a die stamping system that incorporates predetermined time delay or ejection of the part that is formed and the slug that is pierced therefrom.

BACKGROUND AND SUMMARY OF THE INVENTION

In a typical die stamping apparatus, it is desired to accurately cut, punch or form a part. Such apparatus usually comprises an upper die and a lower die movable with respect to the lower die. In the forming of parts, it has been common to provide a delay in the movement of the lower die upwardly after the part has been formed, cut or punched from the workpiece. Such a time delay has been produced by cam control of the lower die or by a hydraulic system associated with the lower die. A typical example of a hydraulic system is shown in U.S. Pat. Nos. 2,694,567 and 3,570,343.

Such hydraulic systems have a disadvantage in that they require associated hydraulic fluid lines, valves and the like externally of the hydraulic cushion on the press.

In co-pending application Ser. No. 099,914, filed Sept. 22, 1987 now U.S. Pat. No. 4,774,865 having a common assignee with the present application, there is disclosed an arrangement wherein each cylinder assembly includes a first piston associated with and exposed to the inert gas such as nitrogen in the manifold and a second piston engaged by the first piston and urged outwardly into engagement with a punch base. A hydraulic circuit is associated with the second piston and controlled by a valve such that upon downward movement of the first piston hydraulic fluid may flow freely without inhibiting the movement of the first piston, but upon actuation of the valve hydraulic fluid locks the first piston and thereby prevents it from moving upwardly until the valve is actuated so that a predetermined time delay is provided.

Among the objectives of the present invention are to provide a die stamping system which can be provided within the confines of conventional apparatus; which will provide the desired time delay; wherein the time delay can be readily adjusted as desired without disassembling the system; wherein the delay action is positive; which eliminates the need for hydraulic hoses between adjacent cylinder assemblies; wherein heat cylinder assembly can be readily mounted on a manifold without the need for circumferential orientation; wherein the cylinder assemblies have a low profile; wherein the cylinder assemblies can be readily filled with hydraulic fluids; wherein the cylinder assemblies have effective seals; and wherein cylinder assemblies have provision for pressure relief to avoid damage thereto.

In accordance with the invention, each cylinder assembly includes a piston associated with and exposed to the nitrogen in the manifold and to hydraulic pressure. The cylinder assemblies are connected to a single hydraulic valve which has associated therewith an accumulator and which is operated simultaneously to actuate the cylinders. The hydraulic lines to the cylinders are provided in the manifold.

DESCRIPTION

Figure 1:
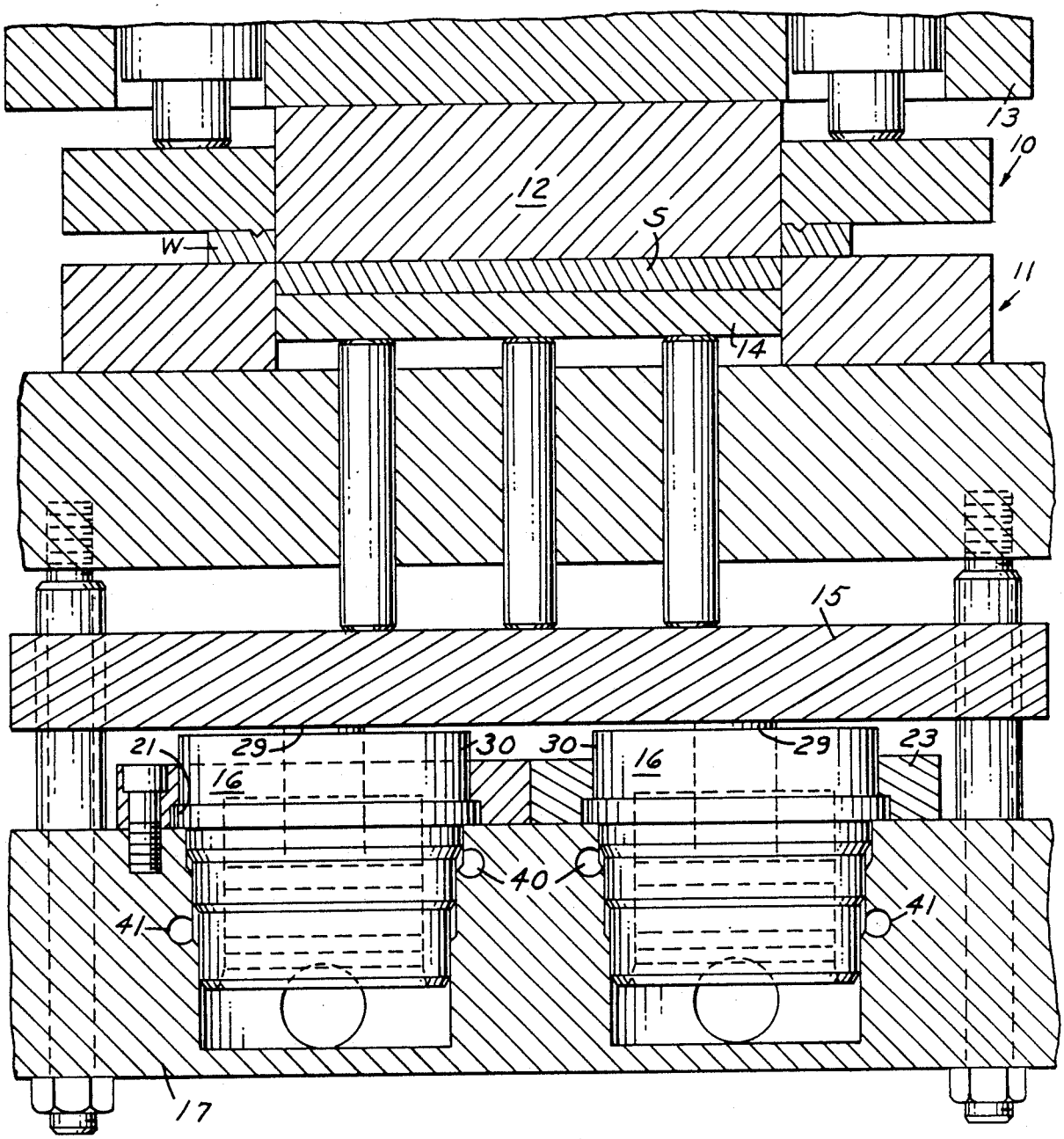
FIG. 1 is a fragmentary sectional view of a fine blanking apparatus embodying the invention.

Referring to FIGS. 1-3 and 7, the die stamping system for fine blanking and embodying the invention is intended to be used with a die stamping apparatus in a press wherein an upper die assembly 10 is provided on the upper portion of the press and a lower die assembly 11 is provided on the lower portion of the press. The upper die 10 includes an upper punch 12 that is movable by a ram 13 downwardly as viewed in FIG. 1 to punch a slug S from a workpiece W. The lower die 11 includes a lower pad 14 associated with the punch 12 and movable downwardly within the die. A pressure plate 15 is supported by a plurality of cylinder assemblies 16 as presently described. The cylinder assemblies 16 are mounted on a manifold 17 which is supplied with inert gas such as nitrogen under a predetermined high pressure. The pressure of the inert gas may vary between about 500 and 2000 PSI.

Each cylinder assembly 16 is provided with hydraulic time delay means such that the upward movement of the pressure plate 15 is delayed when the die is opened thereby insuring that the ejection of the slug S will not interfere with the precise and accurate hole that has been cut in the workpiece W.

Figure 2:
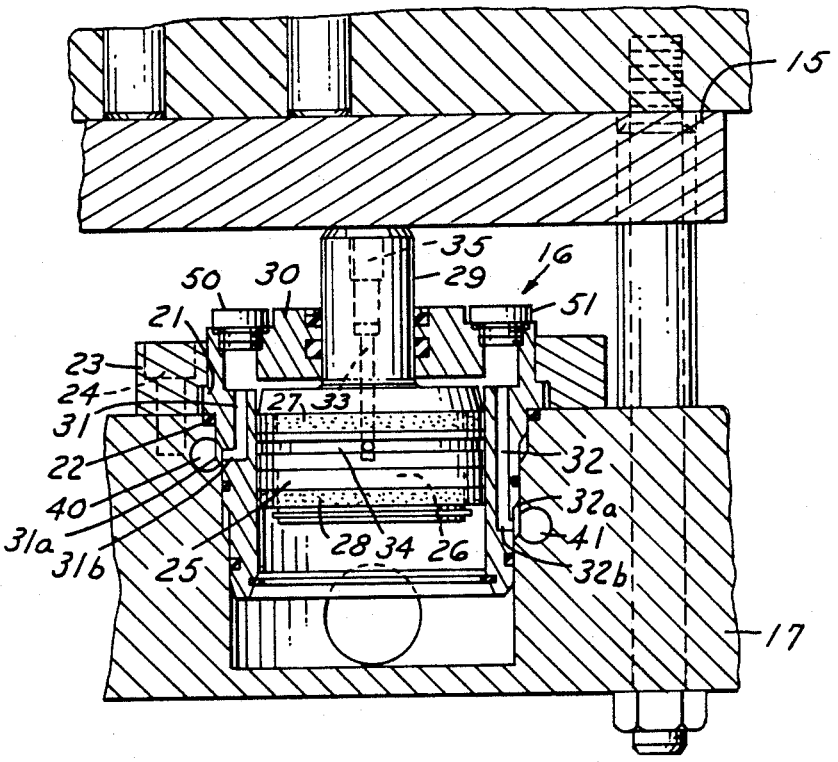
FIG. 2 is a vertical sectional view of a cylinder utilized in the apparatus.
Figure 8:
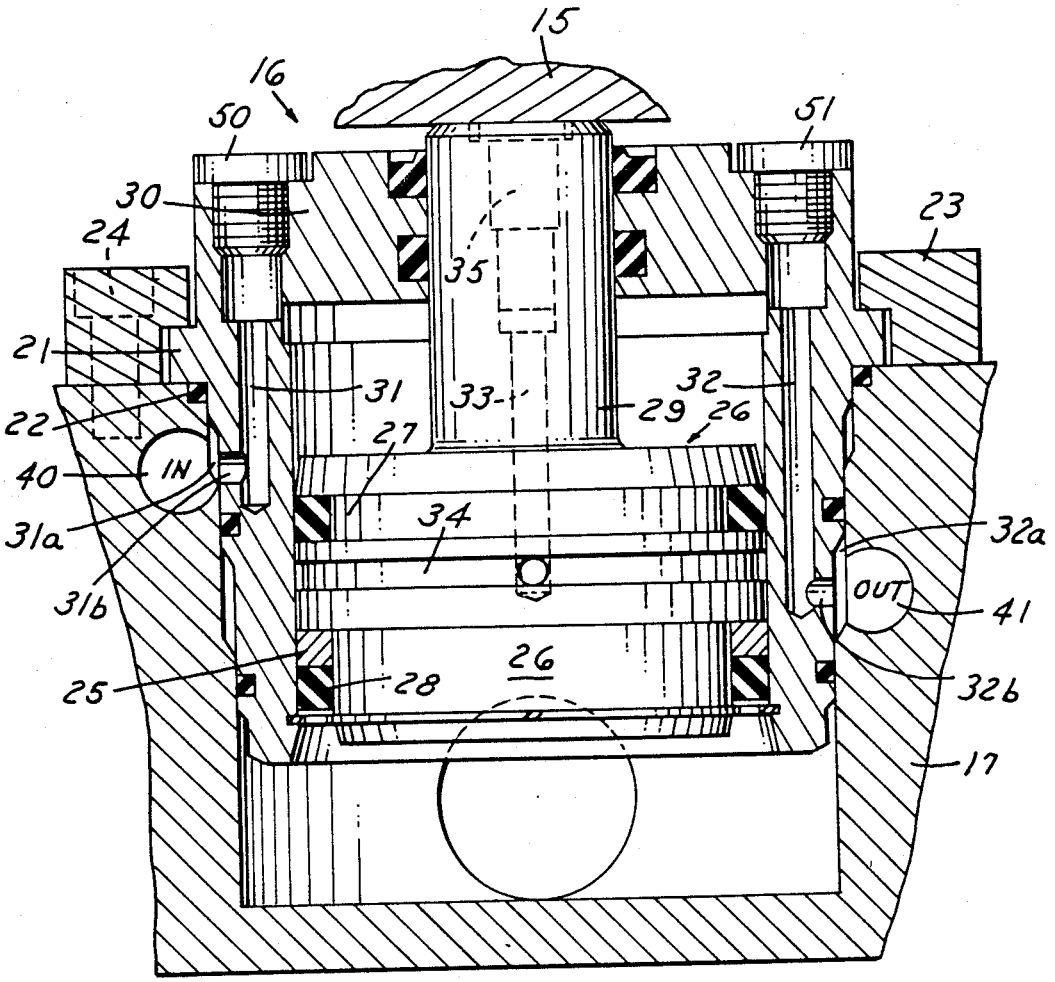
FIG. 8 is on a fragmentary sectional view on an enlarged scale of a cylinder assembly.

As shown in FIGS. 2 and 8, each cylinder assembly 16 includes a cylinder body 20 that has open upper and lower ends. The cylinder body 20 is provided with a flange 21 that engages a shoulder 22 in the manifold 17 and a clamp ring 23 retains the cylinder in position through bolts 24.

The cylindrical body 20 includes a cylindrical opening 25 of substantially constant diameter in which a piston 26 is positioned. The piston 26 has longitudinally spaced seals 27, 28 and free end 29 that extends upwardly through the closed end 30, of the cylinder. The body 20 further includes an axial passage 31 that communicates with the side of the piston for ingress of hydraulic fluid and an axial passage 32 that communicates with the side of the piston for exhaust of the fluid from the upper end of the piston below the closed end 30. The upwardly extending portion 29 of the piston is provided with an axial centrally located passage 33 that communicates with an annular groove 34 positioned between the seals 27, 28 and thereby providing an exhaust through a check valve 35 in passage 33 for exhausting gas that may pass the seal 28 rather than having the gas possibly pass to the hydraulic fluid. By this arrangement the cylinder assembly need not be oriented circumferentially in the manifold.

Figure 4:
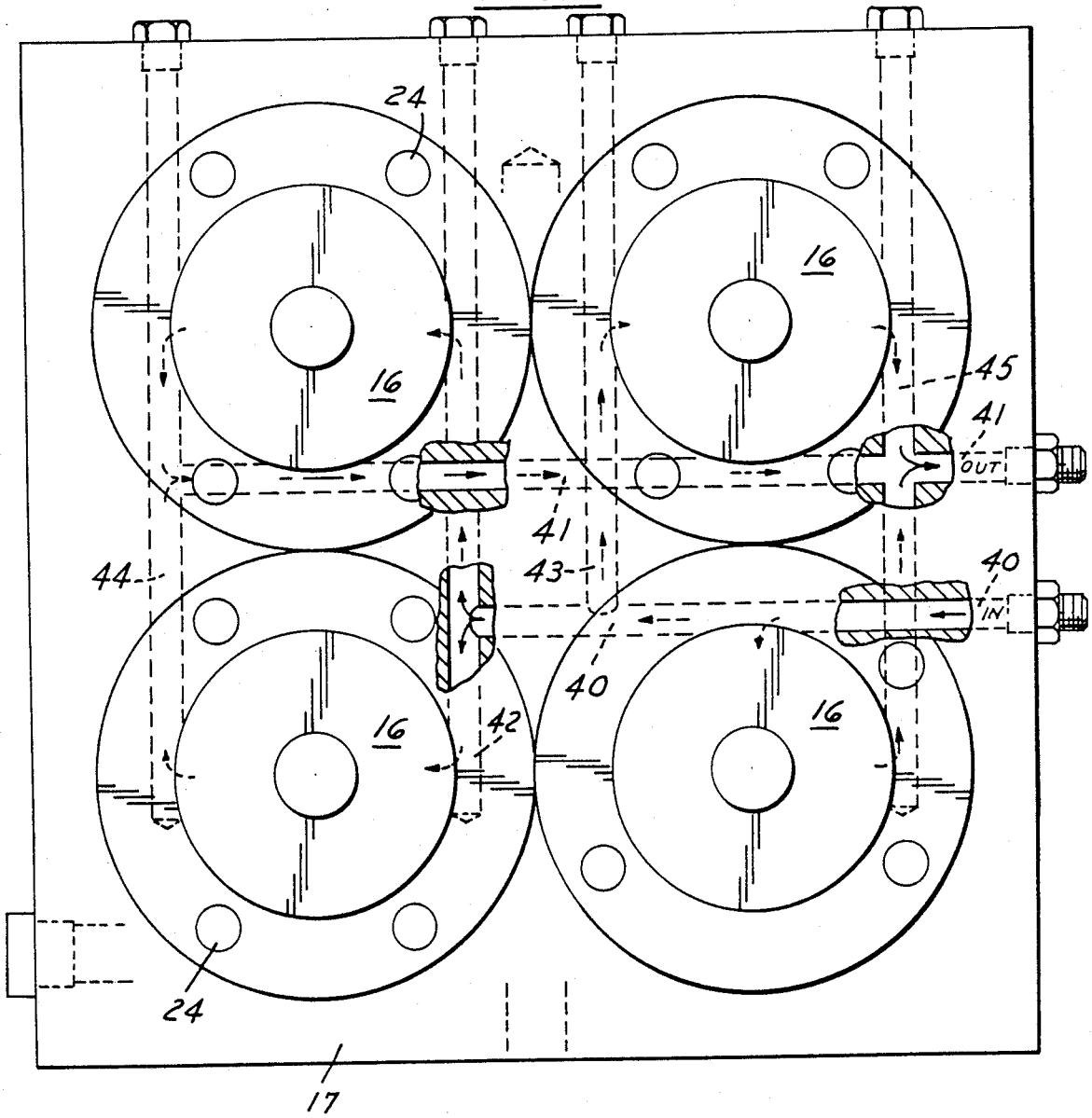
FIG. 4 is a plan view of a manifold.
Figure 5:
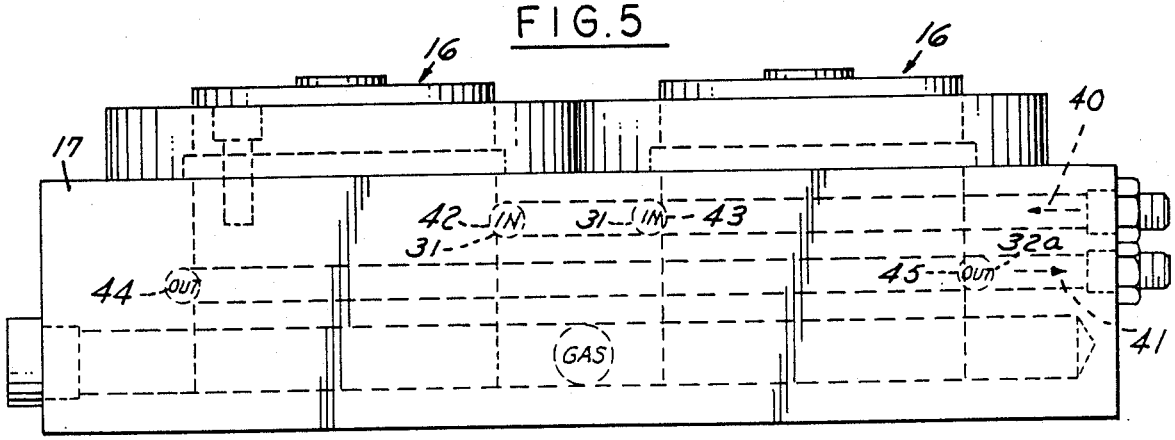
FIG. 5 is an elevational view of the manifold.

Further, in accordance with the invention, the hydraulic passages of the several cylinder assemblies in the single manifold 17 are connected as shown in FIGS. 4 and 5. Specifically the manifold 17 includes an inlet passage 40 and an outlet passage 41 that extend to the exterior of the manifold. The inlet passage 40 extends to lateral passages 42, 43 which tangentially intersect circumferential 31 groove 31*a* at the lower end 31*b* of passage 31 of each of the cylinder assemblies. Similarly the outlet passage 41 intersects lateral passages 44, 45 which tangentially intersect circumferential groove 32*a* at the lower ends 32*b* of the passage 32.

Each cylinder assembly includes removable plugs 50, 51 closing the passages 31, 32 respectively. When the plugs are removed, hydraulic fluid can be inserted through one of the openings purging the oil out of the other of the openings and there by facilitating filling of the respective cylinder assembly.

Figure 6:
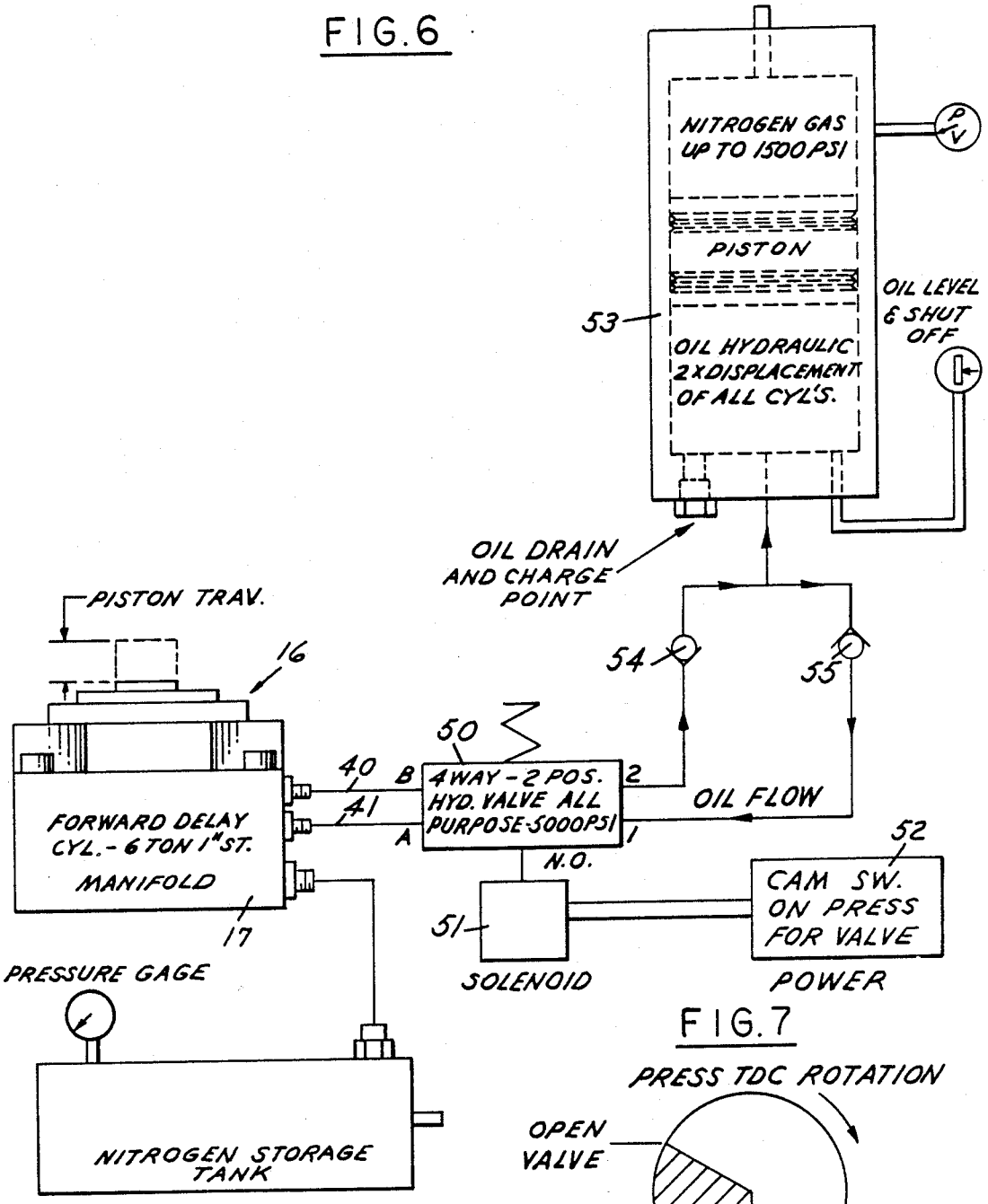
FIG. 6 is a schematic diagram of the system.
Figure 7:
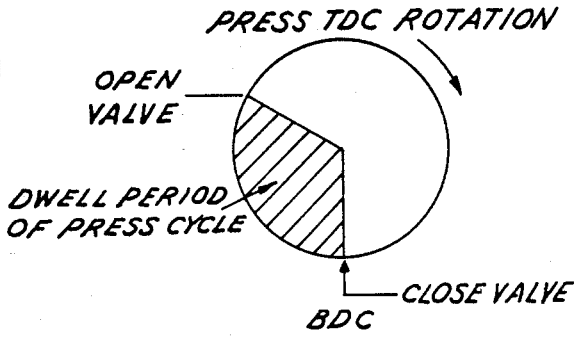
FIG. 7 is a time chart of a typical press cycle.

Referring to FIG. 6, which is a schematic of the system, the inlet and outlet of the hydraulic portion of the system are connected to a four way two position hydraulic valve 50 that is operated by a solenoid 51 in timed relationship to the operation of the press as by a cam 52 to periodically permit or interrupt the flow of the hydraulic fluid from an accumulator 53 through check valves 54, 55 to provide a dwell period or press cycle as shown diagrammatically in FIG. 7, TDC representing top dead center and BDC representing bottom dead center.

Figure 3:
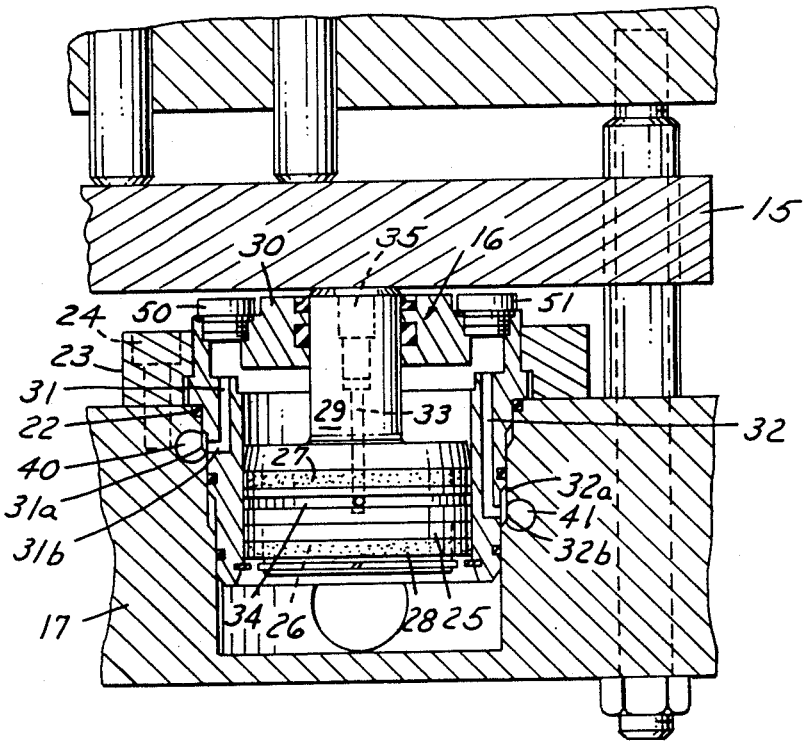
FIG. 3 is a view similar to FIG. 2 showing the parts in a different operative position.

During the downward movement of the upper die, the cylinder assemblies 16 under the action of the compressed nitrogen serve to form a cushion. When the fine blanking operation is completed and the upper die is moved upwardly, the solenoid valve 50 can be energized to cause the plunger to close communication between the passages so that the hydraulic fluid cannot flow and the upper piston 26 is locked in a lower position against movement as shown in FIG. 3. When valve 50 is deenergized, the fluid can then flow freely permitting the piston to move upwardly under the action of the piston 26 and thereby eject the slug S that has been cut or punched from the workpiece.

It can be seen that the length of time delay and the place or position of the piston 40 can be controlled by the duration and timing of energization of the valve 50. The provision of hydraulic passages in the manifold eliminate cumbersome and easily damaged hoses between the cylinder assemblies. The provision of the cylinder assemblies in the manifold lowers the profile of the entire arrangement. The clamping of the cylinder assemblies in position and there construction facilitates mounting of the cylinder assemblies in its respective opening in the manifold and avoids the necessity for orienting the assembly in the manifold. By providing the oil fill plugs, permitting the hydraulic fluid to be readily inserted and the air to be displaced, the charging of the cylinder assemblies with hydraulic fluid is made easier. An effective seal is provided by the double seals on each piston. The pressure relief insures that there will be relief when the pressure exceeds a predetermined amount thereby obviating damage to the cylinder assembly.

As shown in FIG. 6, the oil flow is always in the same direction so that the fluid is always circulated through a respective cylinder assembly. In this manner, the same fluid does not remain within the cylinder assembly but is cooled in the process of circulation.

Figure 9:
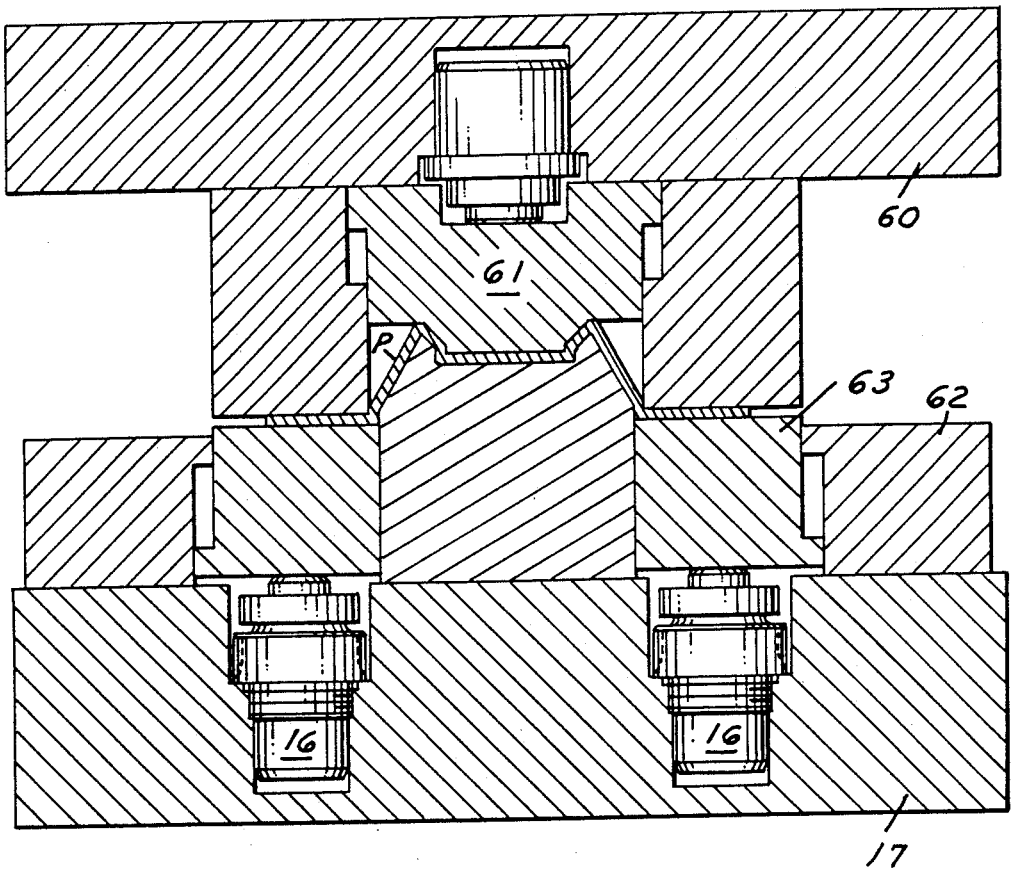
FIG. 9 is a sectional view of a die stamping apparatus embodying the invention.

Although the invention has been described in connection with fine blanking systems, the invention is also applicable to other types of die stamping systems such as that shown in FIG. 9, for example, wherein in the part P being formed has recessed areas and wherein an immediate opening and unclamping of the dies might deform the previously formed deep portions. In such an arrangement, the upper die 60 includes a upper punch 61 and the lower die 62 includes a pressure plate 63 that engages cylinder assemblies 16 which function to delay the injection of the part. In all other respects the construction of the cylinder assemblies and associated manifold 17 is the same.

It can thus be seen that there has been provided a die stamping system which can be provided within the confines or conventional apparatus and is especially applicable for fine stamping; which will provide the desired time delay; wherein the time delay can be readily adjusted as desired without disassembling the system; wherein the delay action is positive; which eliminates the need for hydraulic hoses between adjacent cylinder assemblies; wherein heat cylinder assembly can be readily mounted on a manifold without the need for circumferential orientation; wherein the cylinder assemblies have a low profile; wherein the cylinder assemblies can be readily filled with hydraulic fluids; wherein the cylinder assemblies have effective seals; and wherein cylinder assemblies have provision for pressure relief to avoid damage thereto.

I claim:

1. In a die stamping system that includes opposed die members which clamp a metal workpiece to be cut and pierced after which the die members are moved away from one another and the slugs punched from the blank and the cut blanks are sequentially ejected wherein the ejector is controlled for a selected delay time by a plurality of cylinder assemblies mounted in a manifold so that they are connected to a source of inert gas under high pressure, the improvement wherein each cylinder assembly includes each cylinder assembly including a body and a piston in said body, a hydraulic time delay circuit associated with said cylinder assemblies such that upon downward movement of the pistons, hydraulic fluid may flow freely without inhibiting the movement of the pistons, and upon actuation, hydraulic fluid locks the pistons against movement and thereby prevents them from moving upwardly until the circuit is actuated so that a predetermined time delay is provided, said hydraulic circuit including passages in said manifold communicating with said cylinder assemblies, said hydraulic circuit including a valve externally of said cylinder assemblies and said manifold, and an accumulator connected to said valve, said valve being operable to permit hydraulic fluid to flow freely or to interrupt flow in said circuit and locks said pistons.

2. The die stamping system set forth in claim 1 wherein said passages in said manifold include an inlet passage and an outlet passage in said manifold communicating with said pistons.

3. The die stamping system set forth in claim 2 wherein said passages in said manifold extend tangentially to each said piston, each said piston having an inlet passage and an outlet passage providing communication between said respective inlet and outlet hydraulic passages in the manifold.

4. The die stamping system set forth in claim 3 wherein said passages in said piston including an axial portion and a radial portion.

5. The die stamping system set forth in claim 3 wherein each said piston includes longitudinally spaced seals, and annular groove positioned between said seals and an axial passage in said piston extending to the free end of the piston, a check valve in said passage permitting pressure relief of gas from said manifold that may accumulate in the annular groove to relieve pressure of the gas in said groove.

6. The die stamping system set forth in claim 1 wherein each said cylinder assembly includes a body having spaced passages extending externally over the body, removable filler plugs closing said passages, said passages communicating with said piston such that the cylinder assembly can be filled by removing the plugs and providing fluid in one passages while permitting venting of gas or air out of the other passage.

7. The die stamping system set forth in claim 1 wherein in said manifold includes an inlet passage and an outlet passage communicating with said passages in said manifold, said passages in said manifold extending in tangential relation to each cylinder assembly, the body of each cylinder assembly having a circumferential passages intersecting a respective inlet and outlet passage in said manifold.

* * * * *